US008438697B2

(12) United States Patent
Kim et al.

(10) Patent No.: US 8,438,697 B2
(45) Date of Patent: May 14, 2013

(54) VACUUM CLEANER

(75) Inventors: See-hyun Kim, Gwangju (KR); Byung-jo Lee, Gwangju (KR); Tae-gwang Kim, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 815 days.

(21) Appl. No.: 12/579,697

(22) Filed: Oct. 15, 2009

(65) Prior Publication Data

US 2010/0095476 A1 Apr. 22, 2010

(30) Foreign Application Priority Data

Oct. 17, 2008 (KR) ..... 2008-0102016

(51) Int. Cl.
*A47L 5/36* (2006.01)

(52) U.S. Cl.
USPC ..... 15/334; 15/335; 15/410

(58) Field of Classification Search ..... 15/331, 15/334, 335, 410; *A47L 5/36*
See application file for complete search history.

(56) References Cited

U.S. PATENT DOCUMENTS

| | | | | |
|---|---|---|---|---|
| 7,356,874 | B2 * | 4/2008 | Skinner Macleod et al. | ... 15/328 |
| 2007/0209152 | A1 | 9/2007 | Pullins et al. | |

FOREIGN PATENT DOCUMENTS

| | | |
|---|---|---|
| GB | 2461614 | 1/2010 |
| JP | 2005-110714 | 4/2005 |
| JP | 2006006632 | 1/2006 |
| JP | 2008080042 | 4/2008 |

OTHER PUBLICATIONS

Combined Search and Examination Report issued on Feb. 12, 2010, in corresponding UK Application No. GB0918109.0 (6 pages).

* cited by examiner

*Primary Examiner* — David Redding
(74) *Attorney, Agent, or Firm* — NSIP Law

(57) ABSTRACT

A vacuum cleaner is provided. A vacuum cleaner includes a main body with a suction motor, a dust collecting unit, a main body frame, a locking member, a detaching button, and a pushing member. A suction port assembly is connected to the main body and an extension pipe assembly is detachably attached to the main body; each fluidly connects selectively with the dust collecting unit. The locking member selectively locks the extension pipe assembly to the main body frame, the detaching button selectively detaches the locking member from the extension pipe assembly, and the pushing member moves the extension pipe assembly according to the locking member being detached from the extension pipe assembly.

11 Claims, 8 Drawing Sheets

VACUUM CLEANER

CROSS-REFERENCE TO RELATED APPLICATION(S)

This application claims priority under 35 U.S.C. §119(a) from Korean Patent Application No. 10-2008-0102016, filed on Oct. 17, 2008, in the Korean Intellectual Property Office, the disclosure of which is incorporated herein by reference in its entirety for all purposes.

BACKGROUND

1. Field

The following description relates to a vacuum cleaner, and more particularly, to a vacuum cleaner that can selectively use a suction port assembly or an extension pipe to draw in dirt or dust from a surface being cleaned.

2. Description of the Related Art

Vacuum cleaners can be generally characterized as "upright type" or "canister type."

Upright vacuum cleaners include a suction port assembly and a main body which are typically not connected by an additional hose or extension pipe. In upright vacuum cleaners, the suction port assembly is pressed onto a surface to be cleaned by the weight of a main body. Upright vacuum cleaners generally have a better cleaning efficiency than canister vacuum cleaners.

On the other hand, the canister vacuum cleaners include a suction port assembly and a main body which are typically connected by an extension pipe assembly having a hose and an extension pipe. Manipulation by a user of the suction port assembly of a canister vacuum cleaner is generally easier than that of an upright vacuum cleaner. Accordingly, canister vacuum cleaners are more convenient for cleaning areas where it is difficult for a user to position a main body or suction port assembly (for example, stairs or window frames).

Recently, vacuum cleaners able to convert between upright and canister have been researched in order to facilitate the cleaning of various surfaces.

Such a combined upright and canister vacuum cleaner generally includes a main body, a suction port assembly connected to the main body, and an extension pipe assembly detachable from the main body. The extension pipe assembly is attached to the main body when the combined upright and canister vacuum cleaner is used in an upright mode, and the extension pipe assembly is detached from the main body when the combined upright and canister vacuum cleaner is used in a canister mode.

The main body may include a locking member to selectively lock the extension pipe assembly to the main body and may also include a detaching button to release the locking member from the extension pipe assembly. A user may press the detaching button with his or her finger and pull up the extension pipe assembly with his or her other hand to detach the extension pipe assembly from the main body.

When a user detaches the extension pipe assembly from the main body as described above, the use of both hands may present an inconvenience to the user.

SUMMARY

In one general aspect, a vacuum cleaner includes a main body, a suction port assembly connected to the main body, and an extension pipe assembly detachably attached to the main body The main body includes a suction motor, a dust collection unit, a main body frame, a locking member for selectively locking the extension pipe assembly to the main body frame, a detaching button for selectively detaching the locking member from the extension pipe assembly, and a pushing member for moving the extension pipe assembly according to the locking member being detached from the extension pipe assembly. The suction port assembly and the extension pipe assembly may each fluidly connect selectively with the dust collecting unit.

The main body may further include a locking member spring for applying an elastic force to the locking member to return the locking member to its initial position after the detaching button is pressed and then released, and a detaching button spring for applying an elastic force to the detaching button to return the detaching button to its initial position after the detaching button is pressed and then released.

The locking member may include at least one locking protrusion, and the extension pipe assembly may include at least one first locking groove for engaging the locking protrusion.

The extension pipe assembly may include a handle unit which includes a fixing part with at least one second locking groove formed, and an extension pipe detachably attached to the fixing part of the handle unit.

The pushing member may be a coil spring for applying an elastic force to the extension pipe, the elastic force being applied in a direction toward the handle unit.

The central angle of the least one second locking groove may be between approximately 60° and approximately 120°.

The central angle may be approximately 90°.

The at least one first locking groove may include four locking grooves, and the at least one locking protrusion may include four locking protrusions.

The locking member may include a locking member body which includes the at least one locking protrusion, at least two shafts which supporting the locking member body, and a rotating part integrally formed with the locking member body, the rotating part rotating when the detaching button is pressed by a user or released.

The detaching button may include a rotating part insertion groove having an inclined surface in contact with the rotating part of the locking member, and a contact point between the inclined surface and the rotating part may move in response to the detaching button being pressed or released.

The main body may further include a path conversion unit for selectively connecting the dust collecting unit to a first path and a second path, the first path fluidly connecting with the suction port and the second path fluidly connecting with the extension pipe assembly. The main body may also further include a driving member moved by the extension pipe assembly if the extension pipe assembly is locked to the main body, such that the path conversion unit converts the flow path to the first path, and if the extension pipe assembly is unlocked from the main body, the pushing member moves the driving member such that the path conversion unit converts the path to the second path.

The main body frame may include an extension pipe mount for supporting the extension pipe assembly, the extension pipe mount may including an extension pipe supporting groove for engaging the pushing member and the driving member.

The driving member may include a pedestal part for supporting the extension pipe and a driving part protruding from approximately the center of the pedestal part for driving the path conversion unit, the pushing member including a coil spring disposed between the extension pipe supporting groove and the pedestal part.

Other features and aspects will be apparent from the following detailed description, the drawings, and the claims.

Figure 1:
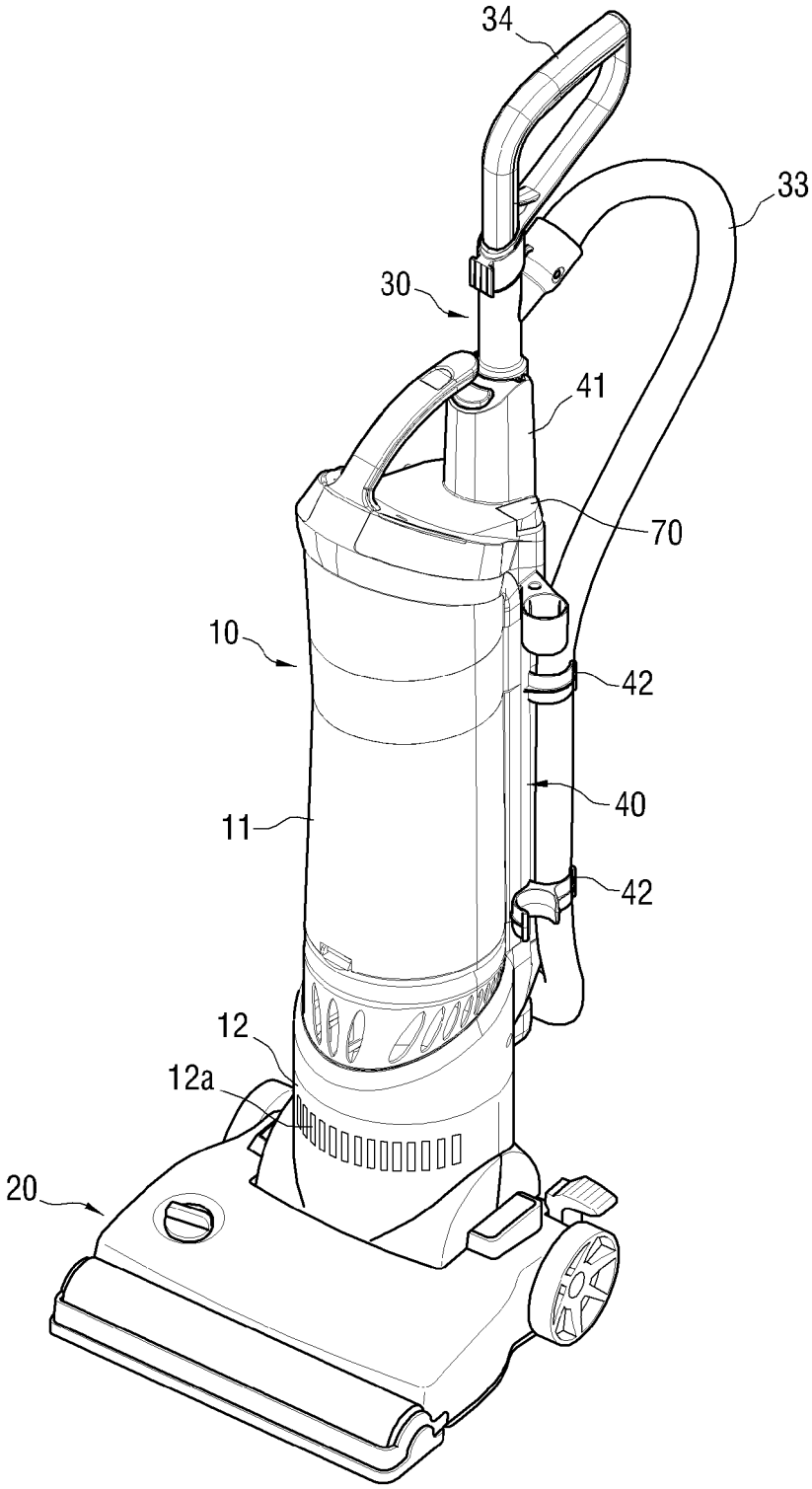
FIG. 1 is a diagram illustrating a front perspective view of an exemplary vacuum cleaner.

Throughout the drawings and the detailed description, unless otherwise described, the same drawing reference numerals will be understood to refer to the same element, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

Figure 3:
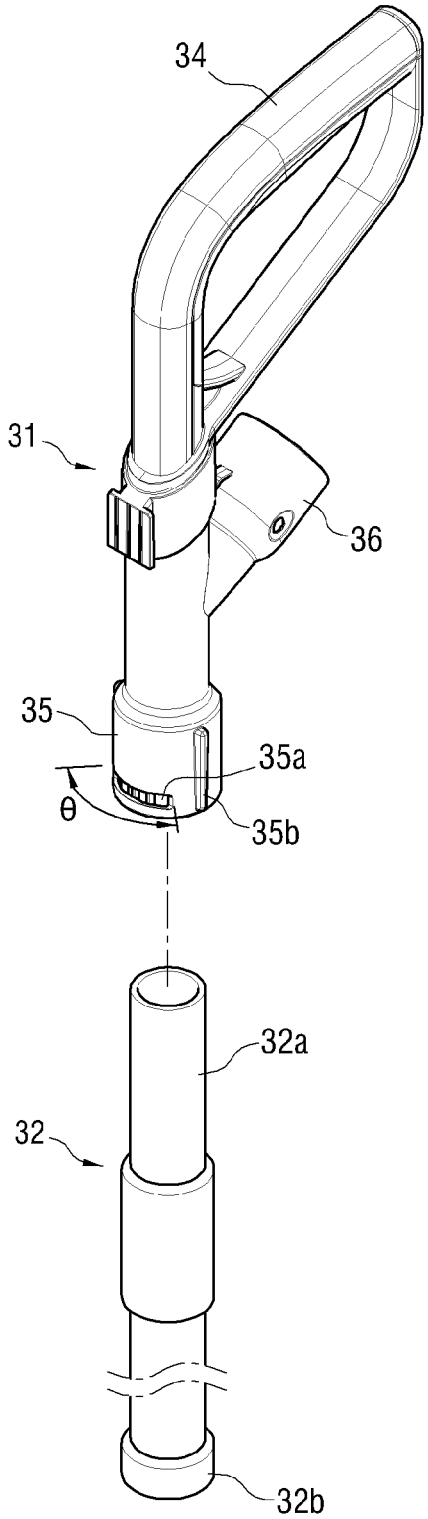
FIG. 3 is a diagram illustrating an exploded perspective view of an extension pipe assembly of the vacuum cleaner of FIG. 1.

Referring to FIGS. 1 and 3, a vacuum cleaner according to an exemplary embodiment includes a main body 10, a suction port assembly 20, and an extension pipe assembly 30.

The main body 10 includes a suction motor (not shown), a dust collecting unit 11, and a main body frame 40. The suction motor is mounted in a motor casing 12, and generates a suction force to draw in dirt or dust. The suction motor also discharges air from which the dirt or dust has been separated outside the cleaner through air discharging holes 12*a* formed on the motor casing 12. The dust collecting unit 11 separates dirt or dust from air drawn in through the suction port assembly 20 or the extension pipe assembly 30 using a dust bag or the centrifugal force.

Figure 2:
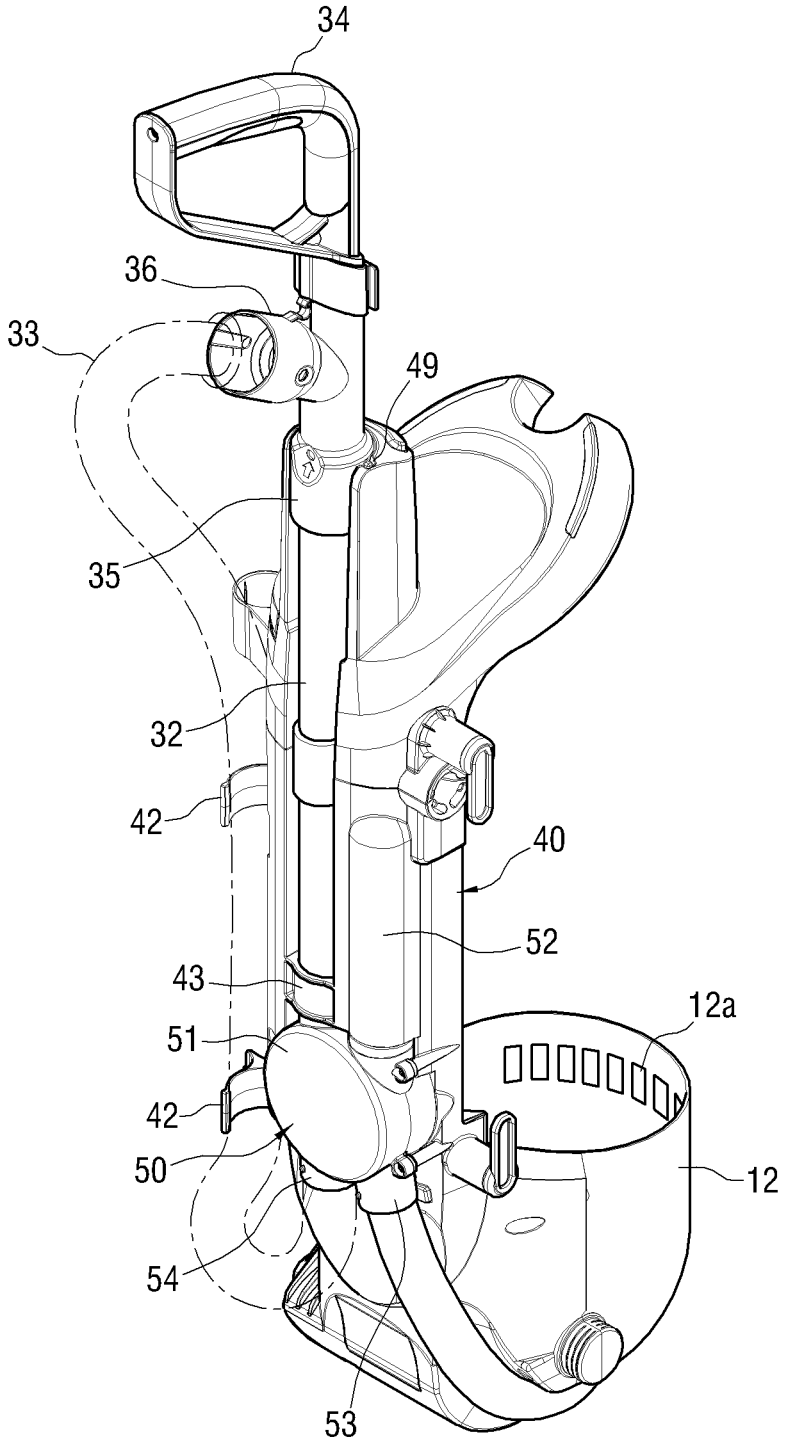
FIG. 2 is a diagram illustrating a rear perspective view of the vacuum cleaner of FIG. 1 in which some parts are omitted for conciseness.

The main body 10 includes a path conversion unit 50 for fluidly connecting either the suction port assembly 20 or the extension pipe assembly 30 to the dust collecting unit 11. As shown in FIG. 2, the path conversion unit 50 includes a path conversion unit casing 51, a guide duct 52, a first suction duct 53, and a second suction duct 54.

The guide duct 52 connects to the dust collecting unit 11, the first suction duct 53 connects to the suction motor in the motor casing 12, and the second duct 54 connects to a flexible hose 33. When the vacuum cleaner is used in an upright mode, a first path in which the first suction duct 53 connects to the guide duct 52 is formed, and when the vacuum cleaner is used in a canister mode, a second path in which the second suction duct 54 connects to the guide duct 52 is formed. Accordingly, when the first path is formed, the suction port assembly 20 may connect to the dust collecting unit 11, and when the second path is formed, the extension pipe assembly 30 may connect to the dust collecting unit 11.

A conversion duct (not shown) and a conversion lever (not shown) are provided in the path conversion unit casing 51 selecting either the first path or the second path. The position of the conversion duct changes together with the rotation of the conversion lever and thus the first suction duct 53 or the second suction duct 54 may selectively connect to the guide duct 52.

The suction port assembly 20 includes a suction port (not shown) on a lower surface thereof to draw in dirt or dust from a surface being cleaned. The suction port assembly 20 is pivotally connected to the main body 10, and the angle between the suction port assembly 20 and the main body 10 may be adjusted appropriately for a user's convenience.

The extension pipe assembly 30 may include a handle unit 31 and an extension pipe 32 as illustrated in FIG. 3.

The handle unit 31 includes a handle 34, a fixing part 35 to which the extension pipe 32 may be attached or detached, and a hose coupling unit 36 which is connected to the flexible hose 33.

Four locking grooves 35*a* are formed around the circumference of the fixing part 35 and four locking protrusions 61 of a locking member 60 (referring to FIG. 6) disposed in the main body frame 40 are inserted into the four locking grooves 35*a*. The central angle (Θ) of the locking grooves 35*a* of the fixing part 35 may be approximately 90°, to facilitate the coupling force between the locking protrusions 61 and the locking grooves 35*a*. The coupling force between the locking protrusions 61 and the locking grooves 35*a* helps prevent the extension pipe assembly 30 from becoming unintentionally detached from the main body while the vacuum cleaner is being used in an upright mode. The central angle (Θ) of the locking grooves 35*a* is not limited to 90°, and may range from about 60° to about 120°, and the number of the locking protrusions 61 and the locking grooves 35*a* is not limited to four.

Two guide protrusions 35*b* are formed on each side of the fixing part 35 in a lengthwise direction to facilitate attaching and detaching the extension pipe assembly 30 to the main body 10. The guide protrusions 35*b* slide along a pair of guide grooves 49 (referring to FIG. 3) formed on an upper end of the main body frame 40 and thus guide the extension pipe assembly 30 during attachment or detachment from the main body 10.

The extension pipe 32 is detachably attached to the fixing part 35 of the handle unit 31. When the vacuum cleaner is in a canister mode, a user may connect an accessory nozzle to a lower part 32*b* of the extension pipe 32 while an upper part 32*a* of the extension pipe 32 is coupled with the fixing part 35 of the handle unit 31, or a user may connect the accessory nozzle directly to the handle unit 31.

The lower part 32*b* of the extension pipe 32 may be integrally formed with the main body frame 40, or may be supported by an extension pipe mount 43, provided as a separate part as illustrated in FIG. 2.

Figure 4:
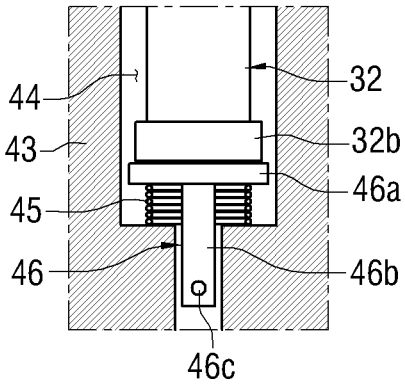
FIG. 4 is a diagram illustrating an interior of an extension pipe mount when the extension pipe assembly of FIG. 3 is locked to a main body of the vacuum cleaner of FIG. 1.
Figure 5:
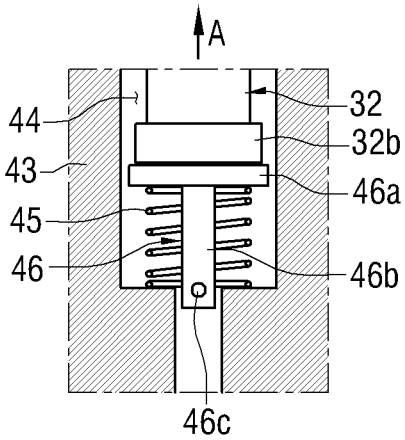
FIG. 5 is a diagram illustrating the interior of the extension pipe mount when the extension pipe assembly of FIG. 3 is released from the main body of the vacuum cleaner of FIG. 1.

Referring to FIGS. 4 and 5, the extension pipe mount 43 may include an extension pipe supporting groove 44 which houses a lower portion including the lower part 32*b* of the extension pipe 32. The extension pipe supporting groove 44 houses therein a driving member 46 for supporting the lower part 32*b* of the extension pipe 32 and a pushing member 45 for elastically pressing the driving member 46, thereby moving the extension pipe 32.

The driving member 46 includes a pedestal part 46*a* and a driving part 46*b*. The top surface of the pedestal part 46*a* contacts and supports the lower part 32*b* of the extension pipe 32 housed in the extension pipe mount 43, and the bottom surface of the pedestal part 46*a* contacts and supports the upper part of the pushing member 45. The driving part 46*b* protrudes vertically from approximately the center of the pedestal part 46*a*. The driving part 46*b* both supports the pedestal part 46*a* and drives the conversion lever (not shown) provided in the path conversion unit casing 51 of the path conversion unit 50 described above (referring to FIG. 2). A push pin 46*c* engaged with the conversion lever protrudes from a lower part of the driving part 46*b*, and the conversion lever of the path conversion unit 50 rotates in a vertical direction in association with the linear motion of the push pin 46*c*.

The pushing member 45 is disposed between the pedestal part 46*a* of the driving member 46 and the extension pipe supporting groove 44. The pushing member 45 according to one example may be a coil spring. If the extension pipe assembly 30 is locked to the main body 10, as shown in FIG. 4, the pushing member 45 maintains a compressed state, and if the extension pipe assembly 30 is released from the main body, as shown in FIG. 5, the pushing member 45 moves the extension pipe 32 together with the driving member 46 in a direction A, illustrated as toward the handle unit 31.

Referring to FIG. 1, a detaching button 70 and a locking member casing 41 are provided on the main body frame 40 of the main body 10. The locking member 60 for locking the extension pipe assembly 30 to the main body frame 40 is provided in the locking member casing 41. The locking member 60 and the detaching button 70 are described below with reference to FIGS. 6 to 8.

Figure 6:
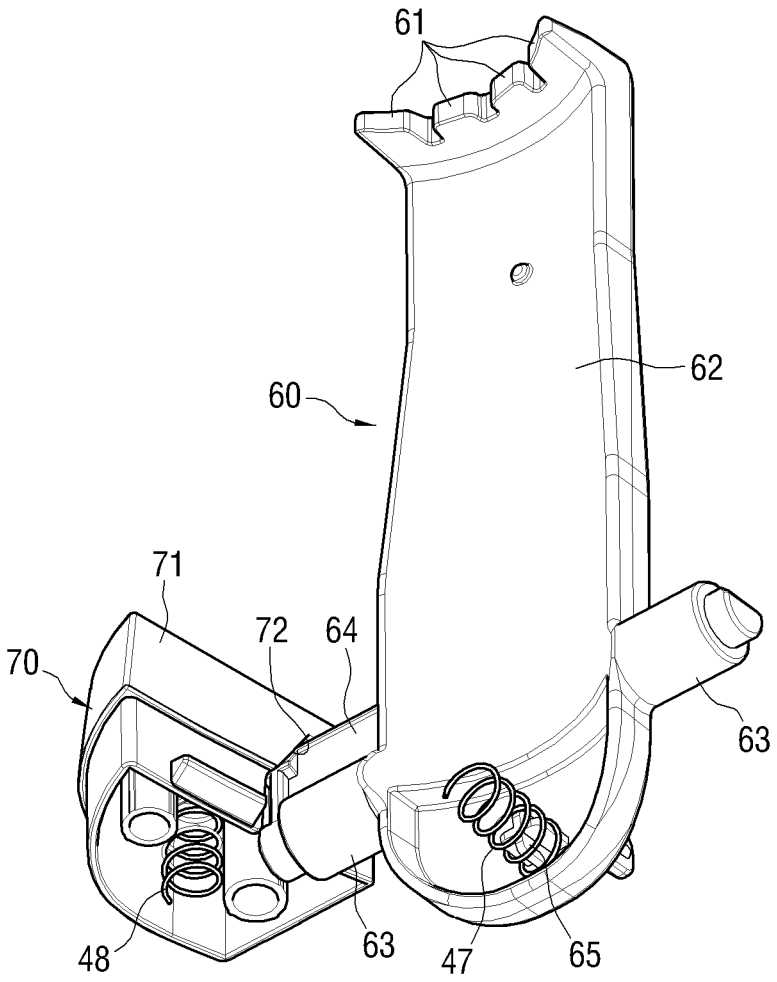
FIG. 6 is a diagram illustrating a perspective view of a locking member and a detaching button of the vacuum cleaner of FIG. 1.
Figure 7:
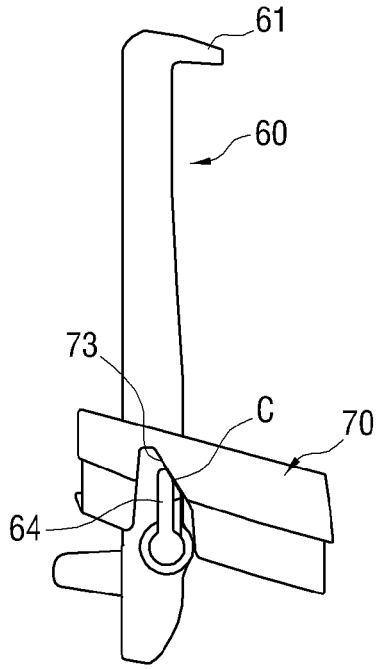
FIG. 7 is a diagram illustrating a side view of the locking member and the detaching button when the detaching button is not in a pressed state.
Figure 8:
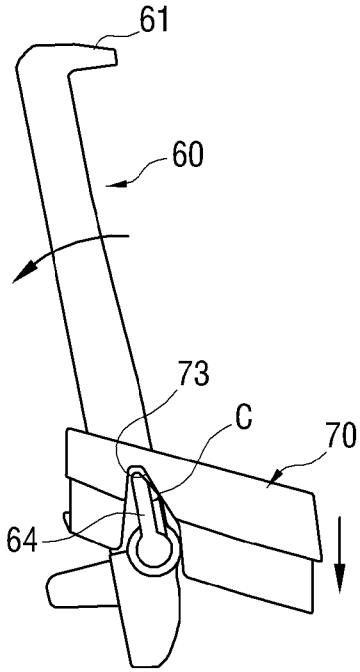
FIG. 8 is a diagram illustrating a side view of the locking member and the detaching button when the detaching button is in a pressed state.

Referring to FIGS. 6 to 8, the locking member 60 includes a locking member body 62 one end of which comprises the four locking protrusions 61 bent approximately perpendicularly, two shafts 63 which protrude externally from the lower side surfaces of the locking member body 62, and a rotating part 64 which protrudes along one shaft 63. A spring mounting protrusion 65 is formed on a bottom part of the locking member body 62 so as to protrude in the same direction as the locking protrusion 61, and a locking member spring 47 is mounted over the spring mounting protrusion 65. The locking member spring 47 applies an elastic force to the locking member 60, causing the locking member 60 to return to the position before the detaching button 70 is pressed.

The detaching button 70 may be configured in an approximately semicircular shape in which a bottom surface is opened, and a detaching button spring 48 elastically pressing the detaching button 70 is mounted inside the detaching button 70. The detaching button spring 48 is configured to apply a force the detaching button 70 such that if a user presses and then releases the detaching button 70, the detaching button spring 48 causes the detaching button 70 to return to the position before the detaching button 70 is pressed.

A rotating part insertion groove 72 having an approximately right-angled triangular shape is formed on a part of the detaching button 70. The rotating part insertion groove 72 has an inclined surface 73 which contacts one end of the rotating part 64 of the locking member 60. While the detaching button 70 is pressed or returns to the previous position, a contact point C between the rotating part 64 and the inclined surface 73 is changed and the rotating part 64 rotates in a clockwise direction or a counter clockwise direction.

More specifically, if the detaching button 70 is pressed while the locking protrusion 61 is engaged with the locking grooves 35*a* as shown in FIG. 7, the contact point C between the rotating part 64 of the locking member 60 and the inclined surface 73 of the detaching button 70 moves such that the rotating part 64 rotates in a counter clockwise direction. The locking member 60 integrally formed with the rotating part 64 rotates in a counter clockwise direction together with the rotating part 64, and accordingly the locking member 60 is released from the extension pipe assembly 30.

Hereinbelow, the operation of a vacuum cleaner having features as illustrated above will be described below with reference to FIGS. 2, 4, 5, 9, and 10.

Figure 9:
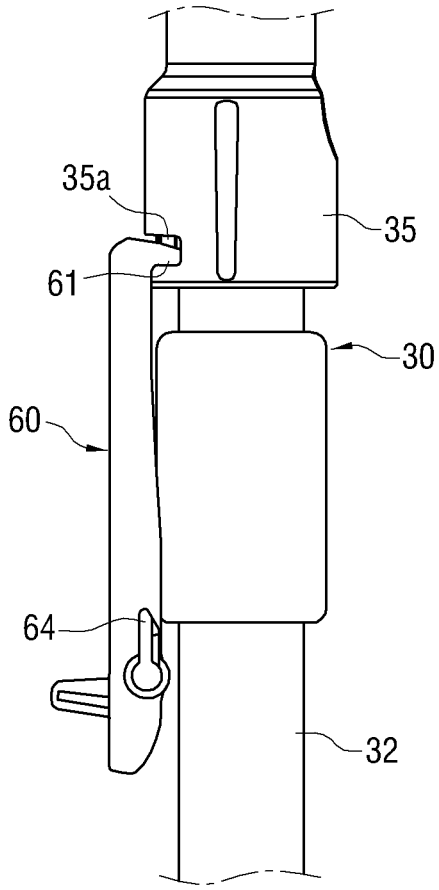
FIG. 9 is a diagram illustrating a side view of the locking member and the detaching button when the extension pipe assembly is locked to the locking member.

If a vacuum cleaner is to be used in an upright mode, the locking member 60 causes the extension pipe assembly 30 to remain locked to the main body 10 as shown in FIG. 9, and the pushing member 45, which is a coil spring, remains in a compressed state due to the pressure of the lower part 32*b* of the extension pipe 32 as shown in FIG. 4. Referring to FIG. 2, the conversion duct (not shown) provided in the path conversion unit casing 51 is disposed such that the first suction duct 53 is able to communicate with the guide duct 52. Accordingly, dirt or dust drawn in through the suction port assembly 20 is drawn into the dust collecting unit 11 through the first path, in which the dirt or dust passes through the first suction duct 53, the conversion duct, and the guide duct 53.

Figure 10:
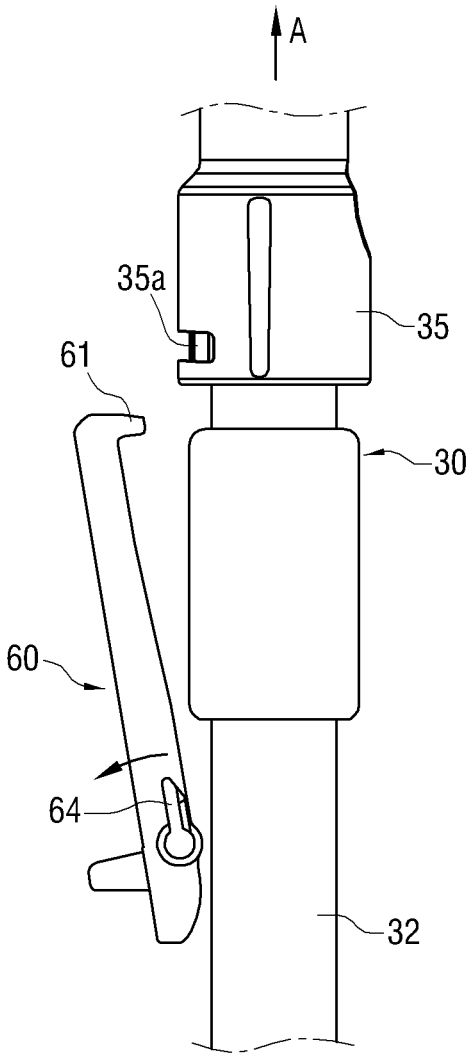
FIG. 10 is a diagram illustrating a side view of the locking member and the extension pipe assembly when the extension pipe assembly is released from the locking member.

To convert the vacuum cleaner to a canister mode, a user may press the detaching button 70 disposed on the upper end of the main body frame 40. The locking member 60 rotates in a counter clockwise direction and thus the lock between the locking member 60 and the extension pipe assembly 30 is released as shown in FIG. 10, and the pushing member 45 extends thereby causing the driving member 46 and the extension pipe 32 to be moved in a direction A, illustrated as toward the handle unit 30 as shown in FIG. 5. Accordingly, if the detaching button 70 is pressed, the extension pipe assembly 30 is released from the locking member 60 and raised up in a direction A.

If the detaching button 70 is pressed, the driving member 46 is also raised and the conversion lever (not shown) in the path conversion unit casing 51 connected to the driving member 46 rotates. Therefore, the position of the conversion duct changes to another position in which the second suction duct 54 communicates with the guide duct 52. Accordingly, the second path in which dirt or dust passes sequentially through the second suction duct 54, the conversion duct, and the guide duct 52 is formed, and thus dirt or dust may be drawn in through the extension pipe assembly 30.

A user may further raise the extension pipe assembly 30 which the pushing member 45 moves so that the extension pipe assembly 30 can be detached from the main body 10 and the accessory nozzle can be mounted to the lower part 32*b* of the extension pipe 32 or on the fixing part 35 of the handle unit 31. Accordingly, a user may use the vacuum cleaner in a canister mode.

According to one example, if a user presses a detaching button, the extension pipe assembly 30 is unlocked from the main body 10 and the extension pipe assembly 30 is automatically moved. Therefore, a user does not have to move up the extension pipe assembly at the same time of pressing the detaching button.

The pushing member 45 for moving the extension pipe assembly 30 is configured such that the pushing member 45 moves the driving member 46, pressing the conversion lever of the path conversion unit 50 together with the extension pipe assembly 30. Accordingly, the number of parts in the vacuum cleaner may be reduced and the structure of the vacuum cleaner may be simplified.

As the central angle of the locking grooves 35*a* formed on the extension pipe assembly 30 may be greater than that of conventional locking grooves, the extension pipe assembly 30 becoming unintentionally detached from the main body 10 while a user uses the vacuum cleaner in an upright mode may be reduced compared to a conventional vacuum cleaner.

According to examples(s) described above, an extension pipe assembly can be unlocked from a main body and automatically pushed up to a specific height if a user only presses a detaching button using a hand. Accordingly, the user may not need to use both hands in order to both press the detaching button and push up the extension pipe assembly.

A pushing member pushing up the extension pipe assembly in a lengthwise direction may be configured to push up a driving member for pressing a conversion lever of a path conversion unit. Accordingly, a number of parts may be reduced and the structure of a resulting vacuum cleaner may be simplified.

A locking groove formed on the extension pipe assembly may have a central angle greater than those of conventional vacuum cleaners. When using such a vacuum cleaner in an upright mode, the possibility of such extension pipe assembly being unintentionally detached from the main body of the vacuum cleaner while the vacuum cleaner is being used may be reduced.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A vacuum cleaner comprising:
a main body;
a suction port assembly connected to the main body; and
an extension pipe assembly detachably attached to the main body,
wherein the main body comprises:
a suction motor;
a dust collection unit;
a main body frame;
a locking member for selectively locking the extension pipe assembly to the main body frame;
a detaching button for selectively detaching the locking member from the extension pipe assembly;
a pushing member for moving the extension pipe assembly according to the locking member being detached from the extension pipe assembly;
a locking member spring for applying an elastic force to the locking member to return the locking member to its initial position after the detaching button is pressed and then released; and
a detaching button spring for applying an elastic force to the detaching button to return the detaching button to its initial position after the detaching button is pressed and then released, and
wherein the suction port assembly and the extension pipe assembly each fluidly connects selectively with the dust collection unit.

2. The vacuum cleaner as claimed in claim 1, wherein the locking member comprises at least one locking protrusion, and the extension pipe assembly comprises at least one first locking groove for engaging the locking protrusion.

3. The vacuum cleaner as claimed in claim 2, wherein the extension pipe assembly comprises:
a handle unit including a fixing part with at least one second locking groove formed; and
an extension pipe detachably attached to the fixing part of the handle unit.

4. The vacuum cleaner as claimed in claim 3, wherein the pushing member is a coil spring for applying an elastic force to the extension pipe, wherein the elastic force is applied in a direction toward the handle unit.

5. The vacuum cleaner as claimed in claim 3, wherein the central angle of the at least one second locking groove is between approximately 60° and approximately 120°.

6. The vacuum cleaner as claimed in claim 5, wherein the central angle is approximately 90°.

7. The vacuum cleaner as claimed in claim 2, wherein the at least one first locking groove includes four locking grooves, and the at least one locking protrusion includes four locking protrusions.

8. The vacuum cleaner as claimed in claim 2, wherein the locking member comprises:
a locking member body which includes the at least one locking protrusion;
at least two shafts supporting the locking member body; and
a rotating part integrally formed with the locking member body,
wherein the rotating part rotates when the detaching button is pressed or released.

9. The vacuum cleaner as claimed in claim 8, wherein the detaching button comprises a rotating part insertion groove having an inclined surface in contact with the rotating part of the locking member, wherein a contact point between the inclined surface and the rotating part moves in response to the detaching button being pressed or released.

10. A vacuum cleaner comprising:
a main body;
a suction port assembly connected to the main body; and
an extension pipe assembly detachably attached to the main body,
wherein the main body comprises:
a suction motor;
a dust collection unit;
a main body frame;
a locking member for selectively locking the extension pipe assembly to the main body frame;
a detaching button for selectively detaching the locking member from the extension pipe assembly;
a pushing member for moving the extension pipe assembly according to the locking member being detached from the extension pipe assembly;
a path conversion unit for selectively connecting the dust collecting unit to a first path and a second path, wherein the first path fluidly connects with the suction port and the second path fluidly connects with the extension pipe assembly; and a driving member moved by the extension pipe assembly if the extension pipe assembly is locked to the main body, such that the path conversion unit converts the flow path to the first path, wherein the suction port assembly and the extension pipe assembly each fluidly connects selectively with the dust collecting unit, wherein, if the extension pipe assembly is unlocked from the main body, the pushing member moves the driving member such that the path conversion unit converts the flow path to the second path, wherein the main body frame includes an extension pipe mount for supporting the extension pipe assembly, and wherein the extension pipe mount comprises an extension pipe supporting groove for engaging the pushing member and the driving member.

11. The vacuum cleaner as claimed in claim 10, wherein the driving member comprises:

a pedestal part for supporting the extension pipe; and a driving part protruding from approximately the center of the pedestal part for driving the path conversion unit, wherein the pushing member includes a coil spring disposed between the extension pipe supporting groove and the pedestal part.

* * * * *